US006286437B1

(12) United States Patent
Lucas

(10) Patent No.: US 6,286,437 B1
(45) **Date of Patent: *Sep. 11, 2001**

(54) RAILWAY CAR OUTLET GATE ASSEMBLY

(75) Inventor: Anthony L. Lucas, Little River, KS (US)

(73) Assignee: ASF-Keystone, Inc., Chicago, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/166,675

(22) Filed: Oct. 5, 1998

(51) Int. Cl.[7] ..... B61D 7/00
(52) U.S. Cl. ..... 105/282.3; 105/282.2
(58) Field of Search ..... 105/238.1, 247, 105/280, 282.1, 282.2, 282.3, 286, 288, 289, 290, 294, 305; 222/542, 559, 561

(56) References Cited

U.S. PATENT DOCUMENTS

| | | | |
|---|---|---|---|
| Re. 26,093 | 10/1966 | Ingram | 105/253 |
| 2,167,364 | 7/1939 | Johnson | 105/247 |
| 2,186,700 | 1/1940 | Johnson | 105/243 |
| 2,751,860 | 6/1956 | Dath | 105/282 |
| 2,751,861 | 6/1956 | Withall | 105/282 |
| 2,751,862 | 6/1956 | Dorey | 105/282 |
| 2,853,960 | 9/1958 | Corrigan | 105/423 |
| 2,898,871 | 8/1959 | Dath | 105/253 |
| 2,914,000 | 11/1959 | Mulcahy | 105/250 |
| 2,926,963 | 3/1960 | Dorey | 302/52 |
| 2,950,144 | 8/1960 | Dorey | 302/52 |
| 2,962,325 | 11/1960 | Dorey | 302/52 |
| 2,969,083 | 1/1961 | Joyce | 137/269 |
| 3,020,093 | 2/1962 | Dorey | 302/52 |
| 3,085,517 | 4/1963 | Smith | 105/282 |
| 3,138,117 | 6/1964 | Dorey | 105/282 |
| 3,174,807 | 3/1965 | Adler | 302/52 |
| 3,192,874 | 7/1965 | Dorey | 105/247 |
| 3,348,501 | 10/1967 | Stevens, et al. | 105/248 |
| 3,360,302 | 12/1967 | Bagguley | 302/52 |
| 3,373,884 | 3/1968 | Dorey | 214/83.18 |
| 3,393,017 | 7/1968 | Smith | 302/52 |
| 3,446,538 | 5/1969 | Danielson | 302/52 |
| 3,486,241 | 12/1969 | Coyle et al. | 34/22 |
| 3,532,062 * | 10/1970 | Pulcrano | 105/282.1 |
| 3,539,224 | 11/1970 | Beezhold | 302/52 |
| 3,578,815 | 5/1971 | Mundinger et al. | 302/52 |
| 3,639,007 | 2/1972 | Dare et al. . | |
| 3,650,567 | 3/1972 | Danielson | 302/52 |
| 3,742,865 * | 7/1973 | Adler | 105/282.1 |
| 3,888,188 | 6/1975 | Fuller | 105/282 R |
| 4,360,295 | 11/1982 | Anderson | 406/75 |
| 4,428,504 | 1/1984 | Basset et al. . | |
| 4,617,868 | 10/1986 | Wahlstrom et al. | 105/282 A |
| 5,507,235 | 4/1996 | Dugge et al. | 105/282.3 |

OTHER PUBLICATIONS

Keystone Railway Equipment Company, Drawing SE–6286, dated Nov. 19, 1996, Exhibit A.
Keystone Railway Equipment Company, Drawing SE–17071, dated Nov. 20, 1997, Exhibit B.
Keystone Railway Equipment Company, Drawing SE–16236, dated Feb. 9, 1995, Exhibit C.
Keystone Railway Equipment Company, Drawing SE–16231, dated May 6, 1995, Exhibit D.
Keystone Railway Equipment Company, Drawing SE–17550, dated Feb. 25, 1997, Exhibit E.

* cited by examiner

*Primary Examiner*—Mark T. Le
(74) *Attorney, Agent, or Firm*—Edwarrd J. Brosius

(57) ABSTRACT

An outlet gate assembly for a hopper type railway car includes a frame defining a discharge chute. Upper and lower gates are mounted in the frame. A compact rack and pinion opening and closing drive moves the upper gate between open and closed positions. The drive includes a pair of racks mounted on the lower surface of the upper gate and extending into the discharge chute through openings in the frame. The openings are sealed during transit and discharge of lading.

24 Claims, 7 Drawing Sheets

RAILWAY CAR OUTLET GATE ASSEMBLY

FIELD OF THE INVENTION

The invention relates to outlet gate assemblies for railway hopper cars of the type allowing gravity, vacuum and pneumatic discharge of bulk lading.

BACKGROUND OF THE INVENTION

Hopper-type railroad cars are used to transport lading which is discharged through outlet gate assemblies mounted at the bottoms of the cars. Bulk lading transported by hopper cars include finely divided materials such as sugar, flour, wheat, potash and cement. The filled hopper cars are delivered to shipper's terminals for unloading.

Conventional methods used to unload hopper cars include gravity discharge, vacuum discharge and pneumatic discharge of lading. During gravity discharge lading falls by gravity through a discharge opening in an outlet gate assembly. During vacuum discharge lading falls down from the car through an outlet gate and into a closed discharge chute. A vacuum hose is connected to the discharge chute and vacuum is applied to the hose. Air drawn into the discharge chute carries the lading along the discharge chute and into the vacuum hose. During pneumatic discharge of lading a pneumatic sled is attached to the bottom of the discharge opening. The pneumatic sled includes screw-type conveyors for discharging lading from the hopper car. Compressed air is blown into the discharge opening to pressurize the inside of the hopper car and separate compacted lading. The lading falls through the discharge opening and into the screw conveyors for removal.

Each unloading method requires its own specialized equipment to unload a hopper car. Nonetheless, a shipper may require one unloading method over another. Typically, a shipper's terminal can accommodate only one method for unloading a hopper car. For instance, one shipper may gravity discharge sugar from a hopper car while another shipper may vacuum discharge sugar from a hopper car. As a result, shipper requirements dictate the type of hopper car used to transport lading to discharge terminals.

To provide flexibility to the railroads, conventional outlet gate assemblies permit gravity discharge, vacuum discharge or pneumatic discharge. The same hopper car can accommodate all shippers without regard to the particular discharge method required. This flexibility gives the railroads increased freedom in scheduling hopper cars, particularly for seasonal loads, and reduces operating costs.

The known multi-discharge gate assemblies include a rectangular frame that defines a rectangular discharge opening at the bottom of the assembly. A pair of opposed vacuum nozzles are mounted on the frame and open into the discharge opening. Upper and lower gates are mounted in the frame. Each gate is supported on its edges by the frame and extends through a slot in one side of the frame. Slot seals prevent exposure of lading to outside contaminants. The gates are movable between closed and opened positions to open and close the upper and lower ends of the assembly.

An opening and closing drive shifts the upper gate between open and closed positions. Fixed racks are mounted on frame extensions located outside sized to extend through a slot and beyond the discharge opening to the frame extension. A walking operating shaft is mounted on the end of the upper gate outside the discharge opening and carries pinions which engage the racks. The operating shaft is rotated in an appropriate direction to move the upper gate and the operating shaft in a desired direction.

A locking mechanism allows the upper gate to be locked to the lower gate so that both gates move together. When the gates are locked together, rotation of the operating shaft simultaneously moves both the upper and lower gates between opened and closed positions. When the gates are unlocked from one another, rotation of the operating shaft moves the upper gate only and the lower gate is stationary.

During gravity or pneumatic sled discharge of lading, the door locking mechanism locks the upper and lower gates together. The operating shaft is rotated to move the upper and lower gates simultaneously from the closed position to the open position. Lading falls down through the gate assembly.

During vacuum discharge of the hopper car, vacuum hoses are attached to the vacuum nozzles. The door locking mechanism is unlocked. The operating shaft is rotated to open the upper gate only. The lower gate remains closed. Lading falls down into the frame but cannot exit through the bottom of the assembly. Vacuum draws air and lading into the vacuum hoses.

The conventional gate assembly includes a bulky rack and pinion drive located to one side of the opening. The pinion gears travel over fixed racks as the upper gate moves between opened and closed positions. The stationary racks extend away from the discharge chute a distance equal to the travel of the upper gate. This type rack and pinion drive greatly increases the size, cost and complexity of the outlet gate assembly.

Thus, there is a need for an improved multi discharge outlet gate assembly having a simpler, more compact and less expensive gate drive.

SUMMARY OF THE INVENTION

The present invention is an improved railway car outlet gate assembly for gravity discharge, vacuum discharge and pneumatic discharge of lading. The gate assembly includes a frame, upper and lower gates, a gate lock and a compact opening and closing drive. Rack extensions are eliminated to reduce the size of the assembly and simplify its construction. The racks are fixed on the bottom of the upper gate. The gate opening and closing drive includes a fixed operating shaft located on the outside of the discharge opening with pinions on the shaft engaging racks on the bottom of the upper gate. The racks extend through openings formed in the frame member on the front of the assembly. Brush and clamp seals close the openings to prevent impurities from entering into the assembly and contaminating lading.

Other objects and features of the invention will become apparent as the description proceeds, especially when taken in conjunction with the accompanying drawings illustrating the invention, of which there are 9 sheets of one embodiment.

DESCRIPTION OF THE PREFERRED EMBODIMENT

Figure 1:
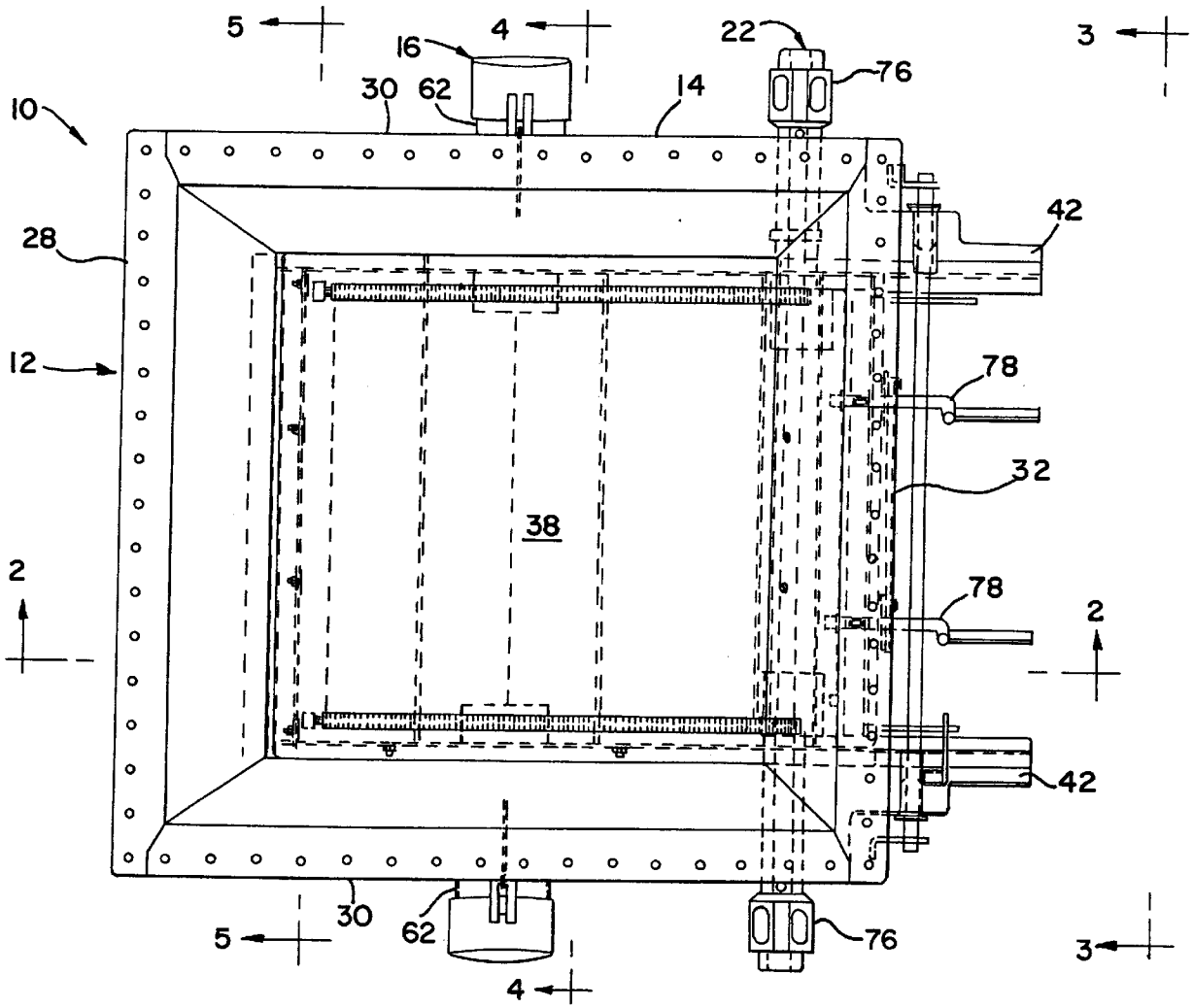
FIG. 1 is a top view of an outlet gate assembly in accordance, with the invention.

Outlet gate assembly 10 includes a rectangular frame 12 including a discharge chute 14. Vacuum nozzle assembly 16 is mounted on frame 12 for vacuum discharge of lading from the chute. A rectangular upper door or gate 18 is mounted at the top of the frame and is movable between a closed position where it completely closes the upper end of the frame and an open position in which upper gate 18 is to the front side of the frame. A rectangular lower door or gate 20 is mounted at the lower end of the frame and is movable between a closed position in which lower gate 20 completely closes the bottom of the frame and an open position. When open, the lower gate 20 is located to the front side of frame 12 under gate 18.

Upper gate 18 is moved between the open and closed positions by a gate opening and closing drive 22. A gate lock mechanism 24 selectively locks lower gate 20 to upper gate 18 for moving both gates simultaneously between the open and closed positions by gate opening and closing drive 22. A conventional gate latch 26 latches the upper gate 18 in the closed position and, through gate lock mechanism 24, holds lower gate 20 closed.

The frame 12 of outlet gate assembly 10 is bolted to a discharge opening at the bottom of a hopper-type railway car (not shown) to control the discharge of lading from the car. The outlet gate assembly may also be bolted to other types of transportable containers, for example, over-the-road hopper-type trailers pulled by tractor trucks.

Frame 12 includes a rear frame member 28, a pair of side frame members 30, and an upper front frame member 32 and a U-shaped lower front frame member 34 both extending between side frame members 30. A square strip flange 36 surrounds discharge opening 38 and is attached to members 28 and 30 and plates 54 and 56 at the bottom of the frame and extends outwardly a short distance beyond the members. A conventional mud plate 40 is removably mounted on the bottom of frame 12 to prevent mud and other contaminants from entering the gate assembly during transit of the rail car.

Frame 12 defines the central, rectangular discharge opening 40 bounded by members 28, 30, 32 and 34. The side frame members 30 include extensions 42 which extend forwardly beyond front members 32 and 34. An upper slot 44 extends across the width of frame 12 between front frame members 32 and 34. A lower slot 46 extends across the width of frame 12 between lower front frame member 34 and plate 56 extending between member 30. Rear slot 48 extends across the width of frame 12 between frame member 28 and plate 54 extending between members 30.

Upper gate 18 is positioned in upper gate slot 44 and extends into discharge opening 38. When closed, the upper gate rests on ledges 50 at the tops of members 28 and 30. Ledges 50 extend along side frame extensions 42 and support the upper gate when open.

Lower gate 20 extends through lower slot 46 and rear slot 48 when closed and is supported on inwardly facing flanges 52 extending along the length of side members 30 and extensions 42. The rear end of the lower gate extending through rear slot 48 is supported by plate 54. The front end of the lower gate is supported by plate 56.

Figure 2:
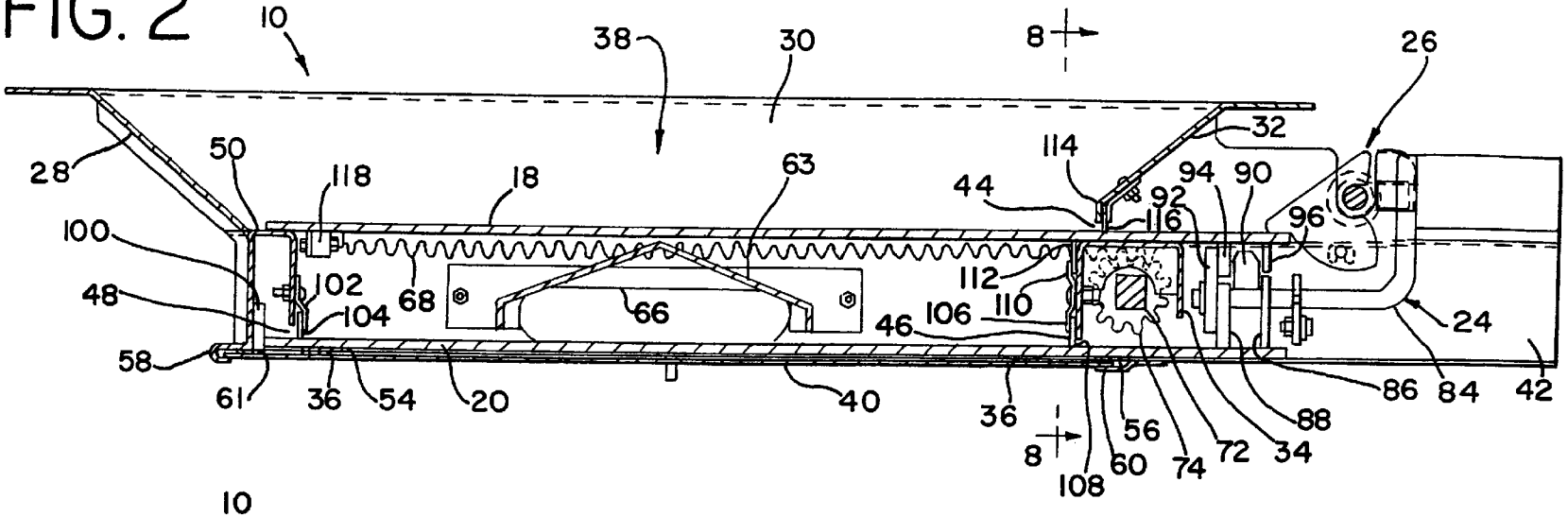
FIG. 2 is a sectional side view of the assembly of FIG. 1 taken along line 2—2 of FIG. 1.

Square flange 36 surrounds the bottom of discharge opening 38 and is adapted to mount and seal a pneumatic sled (not shown) for pneumatic sled discharge of lading. Mud plate 40 is removably mounted below the lower gate 20 when closed. The rear and front ends of mud plate 40 are slideably mounted in hook 58 on rear frame member 28 and hook plate 60 which extends between extensions 42, as shown in FIG. 2. The sides of the mud plate 40 are suitably bolted or pinned to flange 36. Mud plate 40 can be unbolted and removed from the frame to permit gravity or pneumatic discharge of lading.

Flange 36 is adapted to mount and seal a pneumatic sled to the frame. If outlet gate assembly 10 is to be used with different models of pneumatic sled, a different flange 36 may be removably mounted on the frame members. A gasket (not shown) may be located between the flange and the frame members. A discharge slot 61 is provided in the rear side of flange 36 extending along rear frame member 28. When lower gate 20 is closed a small amount of lading may be pushed through rear slot 48. This lading falls down through discharge slot 61 and away from the gate assembly as shown in FIG. 2.

Vacuum nozzle assembly 16 includes a pair of vacuum nozzles 62 extending from opposite sides of frame 12, a removable baffle plate 63 mounted within the frame over the inlets to the nozzles and a pair of removable covers 64 chained to each vacuum nozzle 62. Each vacuum nozzle 62 joins a vacuum inlet opening 66 extending through a side member 30. The vacuum inlet openings 66 are located above the closed lower gate 20. Baffle plate 63 includes a peak above the discharge openings 66 and extends to either side of the vacuum discharge openings. When lower gate 20 is closed, the lower gate and baffle plate define a pair of slots opening into the interior of baffle plate 63 and extending between the side frames 30.

Gate opening and closing drive 22 moves upper gate 18 back and forth between the opened and closed positions through upper slot 44. The drive 22 includes a pair of spaced apart parallel racks 68 mounted on the lower surface of upper gate 18 and extending through openings 70 formed in the top of lower front frame member 34. A square operating shaft 72 is journaled in bearings mounted on side frame extensions 42 and extends through the center of inverted U-shaped lower front frame member 34. Pinion gears 74 are mounted on shaft 64 and engage racks 68. The ends of the operating shaft extend outwardly of the side frame member extensions and support capstans 76. Rotation of the capstans in an appropriate direction rotates the pinion gears and moves plate 18 back and forth on frame 12.

Gate lock mechanism 24 locks the front of the lower gate 20 to the front of the upper gate 18 for movement with the upper gate. Mechanism 24 includes a pair of like locking units 78 mounted on the upper surface of the front end of lower gate 20. Units 78 are inter-connected by lock linkage 82. Each unit 78 includes a rotatable L-shape lock handle 84 having a leg journaled in and extending through a pair of spaced apart mounting plates 86 and 88 attached to the upper surface of lower gate 20. Rotatable lock tab 90 is mounted on the inner end of handle 84 and rotates with the handle. Stop plate 92 is attached to plate 88. Locking plates 94 and 96 are attached to the lower surface of upper gate 18 above plates 88 and 86 when both gates are in alignment, as shown in FIG. 2.

Figure 3:
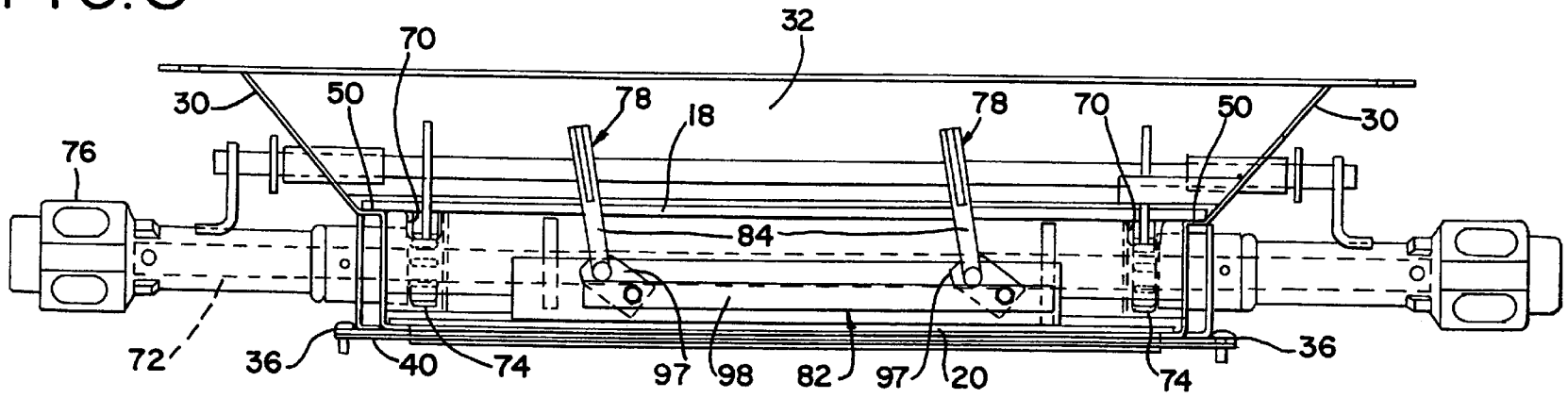
FIG. 3 is a front view of the assembly of FIG. 1 taken along line 3—3 of FIG. 1.
Figure 4:
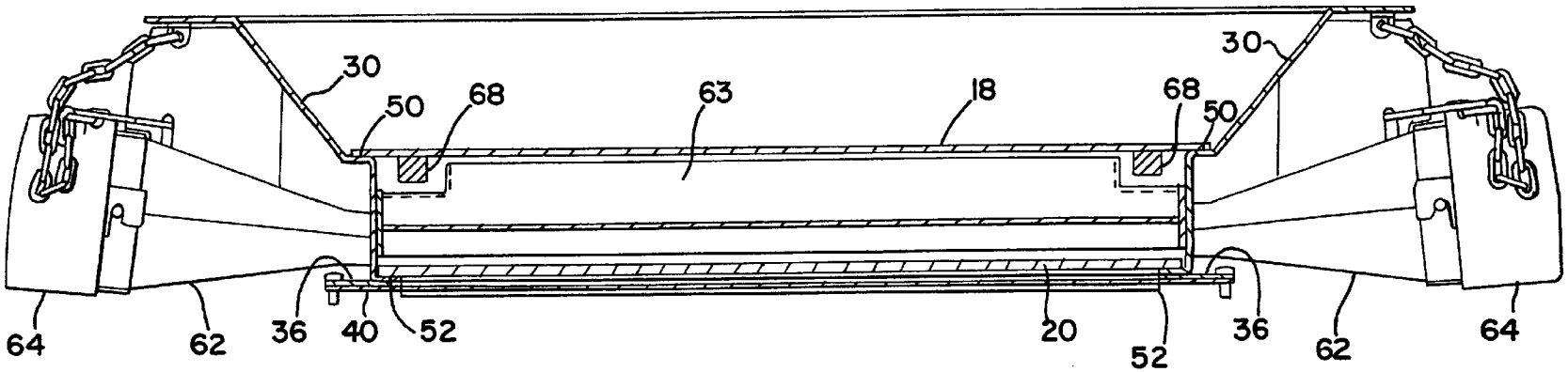
FIG. 4 is a sectional side view of the assembly of FIG. 1 taken along line 4—4 of FIG. 1.
Figure 5:
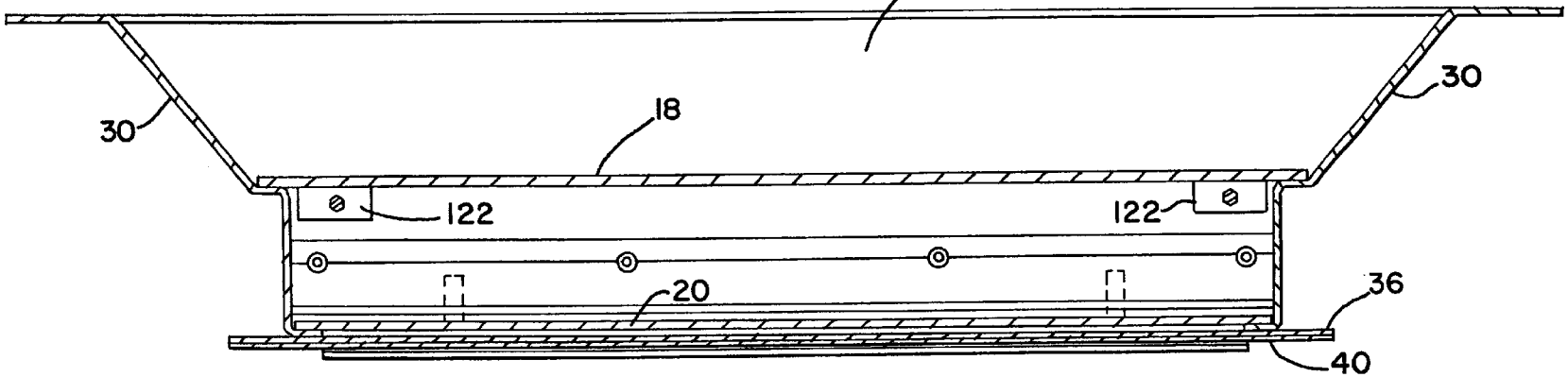
FIG. 5 is a sectional side view of the assembly of FIG. 1 taken along line 5—5 of FIG. 1.
Figure 6:
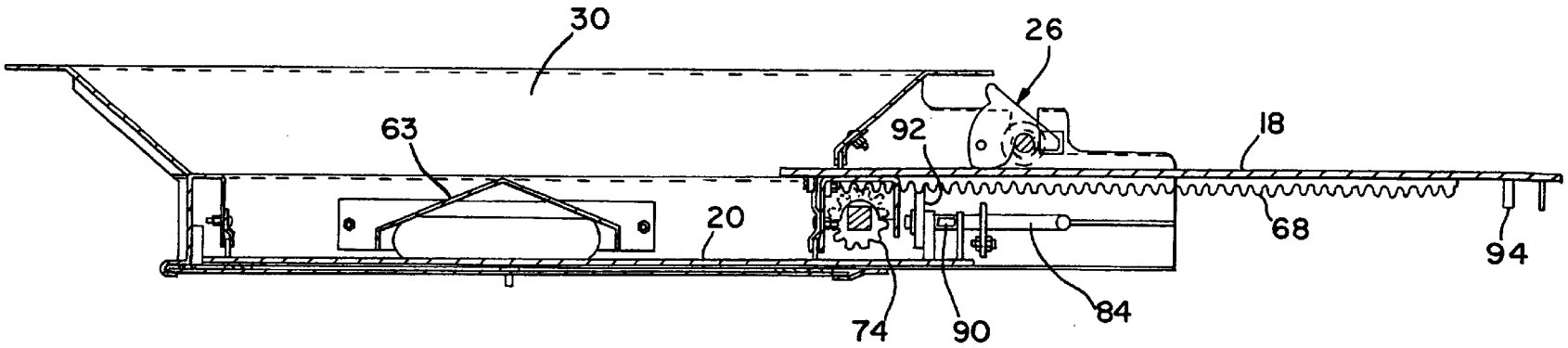
FIG. 6 is similar to FIG. 2 with the upper gate open and the lower gate closed.
Figure 7:
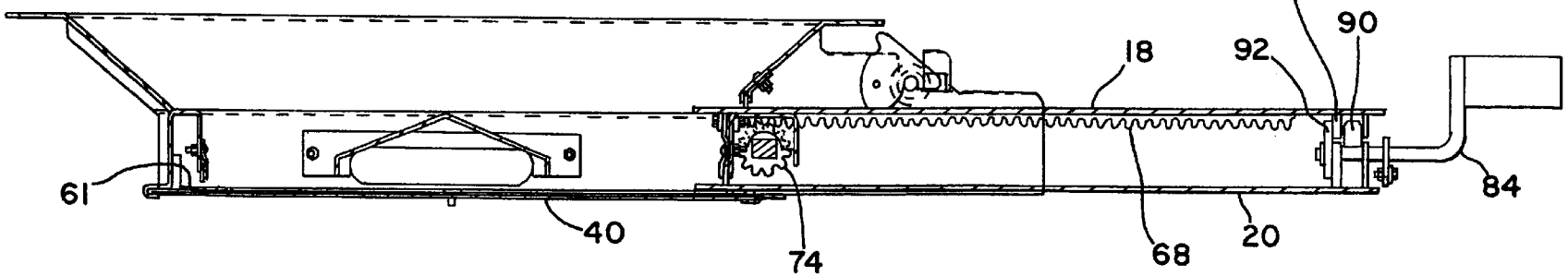
FIG. 7 is similar to FIG. 6 with both upper and lower gates open.
Figure 8:
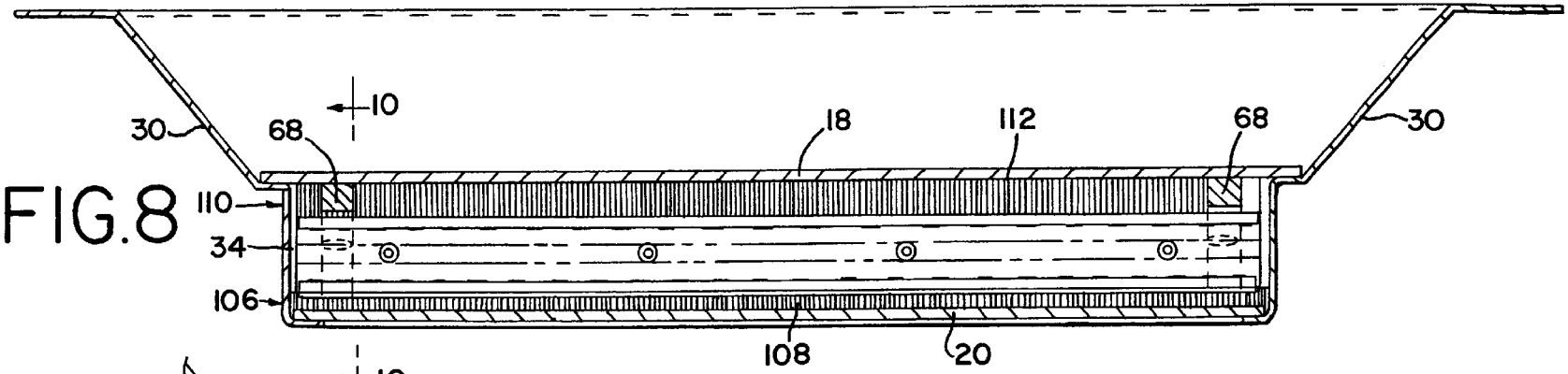
FIG. 8 is a sectional side view of the assembly of FIG. 1 taken along line 8—8 of FIG. 2.

Lock linkage 82, shown in FIG. 3, includes arms 97 on handles 84 and a linkage bar 98 joining the arms radially outwardly from the handles. The linkage assures that handles 84 rotate together to engage and disengage each locking units 78 simultaneously. In FIGS. 2 and 3 locking units 78 are engaged to join the upper and lower gates. In this position tabs 90 extend vertically and are located between plates 94 and 96. The free legs of handles 84 also extend vertically above the upper gate 18 to indicate that the two gates are locked together. The locking mechanisms are disengaged by rotating handles 84 ninety degrees clockwise as shown in FIG. 3 so that the tabs 90 are rotated down and out of engagement with plates 94 and 96 to allow drive 22 to open gate 18 while gate 20 remains closed.

Door stop 100 is mounted on the inside of rear frame member 28 and limits closing movement of the lower gate 20.

Latch 26 is conventional and need not be described further.

Outlet gate assembly 10 includes a lower gate rear seal 102 mounted on rear frame member 28 above lower gate 20 when closed. Seal 102 includes a brush 104 which extends across the width of opening 38. The bristles of brush 104 extend down and engage the top surface of lower gate 20 when closed. The seal 102 is located at rear slot 48.

Lower gate front seal 106 is mounted on lower front frame member 34 facing opening 40 and includes a brush 108 extending across the width of opening 40 with bristles extending downwardly to engage the upper surface of lower gate 20. The seal 106 is located at lower front slot 46.

Upper gate bottom seal 110 is likewise mounted on lower front frame member 34 and includes a brush 112 extending upwardly and across discharge opening 38. The brush engages the lower surface of upper gate 18. Upper gate top seal 114 is mounted on the lower edge of upper frame member 32 and includes a brush 116 extending across the width of opening 38 with bristles extending downwardly and engaging the top surface of the upper gate 18. The bristles of brushes 104, 108, 112 and 116 are preferably formed from stiffly flexible thermoplastic material such as nylon or polypropylene. It is, however, contemplated that the brushes may be formed from other materials as required.

Like seal units 118 are mounted on the lower surface of upper gate 18 at the rear ends of racks 68. Each seal unit includes a plug block 120 welded to the gate 18 and a clamp plate 122 bolted to the rear end of block 120. The height and width of the plug blocks are approximately equal to the height and width of racks 68. Plate 122 has a height equal to the height of the rack and a width appreciably greater than the width of the rack. The total width of the plate is greater than the width of openings 70 in the lower front frame member.

Figure 10:
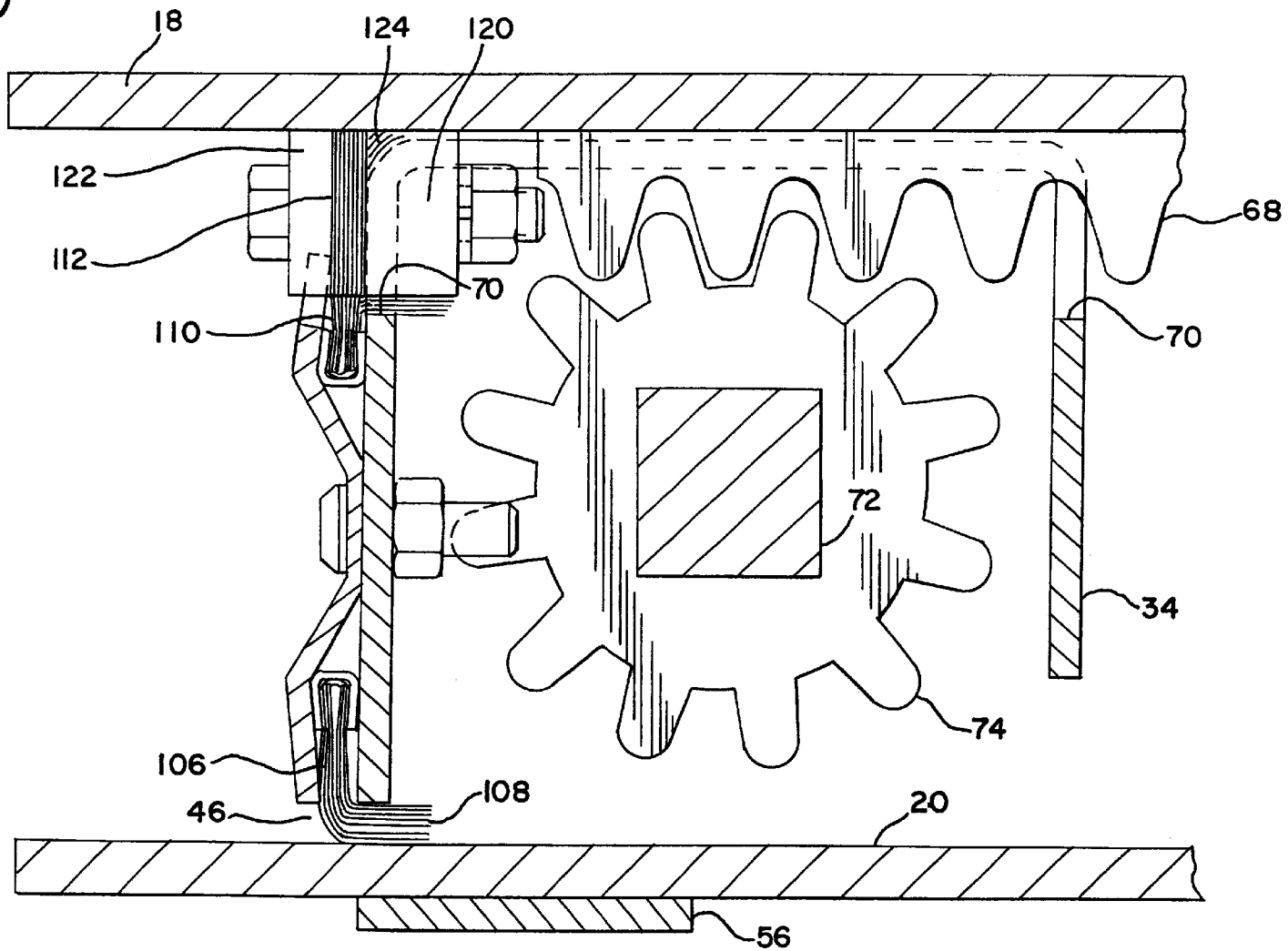
FIG. 10 is a sectional side view taken along line 10—10 of FIG. 8.

Racks 68 extend through openings 70 and past the bristles 124 of brush 112. The bristles surround the sides of racks 68 and cover the rack slots 70 as shown in FIG. 10 to prevent contamination from entering assembly through slots 70. The bristles extend upwardly and engage the lower surface of upper gate 18 to prevent contaminants from entering into the discharge opening and to prevent discharge of lading pass the brush.

The bristles of brush 104 extend across the rear slot 48 to seal rear slot 48 and prevent contaminants from entering into the discharge opening through the rear slot. The bristles of brush 108 extend across lower slot 46 and prevent contaminants from entering into discharge opening through lower slot 46. The bristles of brush 116 extend across upper slot 44 and prevent contaminants from entering into the assembly and prevent discharge of lading in the hopper car through upper slot 44.

The operation of the outlet gate assembly 10 will now be described.

During transport of the hopper car, both upper and lower gates 18 and 20 are fully closed as shown in FIGS. 1 and 2. The bristles of brushes 104, 108, 112 and 116 engage the adjacent sides of the closed gates to prevent contaminants from entering the interior of the outlet gate assembly. Brush 112 of sealing member 110 extends across the rack openings 70 formed in the top of lower front frame member 34. The racks 68 run through the bristles of brush 112. Gate lock mechanism 24 and gate latch mechanism 26 cooperate to keep the gates fully closed during transit.

In order to discharge lading through outlet gate assembly 10, a worker first disengages latch 26. For gravity discharge of lading, both upper gate 18 and lower gate 20 must be opened. Nozzle covers 64 placed on nozzles 62 during transit are retained in place to prevent unwanted discharge of lading through vacuum openings 66 and out the nozzles. Mud plate 40 is removed. If desired, a discharge chute (not shown) can be attached to flange plate 36.

The upper and lower gates 18 and 20 are locked together before opening so that both gates move together. To lock the gates together, a worker rotates one of the lock handles 84 to the locked position. With lock handles 84 in the vertical locked position, each locking tab 90 extends into the space between plates 94 and 96.

The outlet gate assembly 10 may then be opened from either side of the rail car by rotating one of the capstans 76 in an opening direction. The capstan may be rotated by a power drive or a pry bar.

Opening rotation of a capstan rotates the operating shaft 72 and the pinion gears 74 meshed with racks 68 to move upper gate 18 in the opening direction. Plates 92 attached to the lower surface of upper gate 18 push on lock tabs 90 and apply an opening force to lower gate 20 so that both gates open together.

Figure 9:
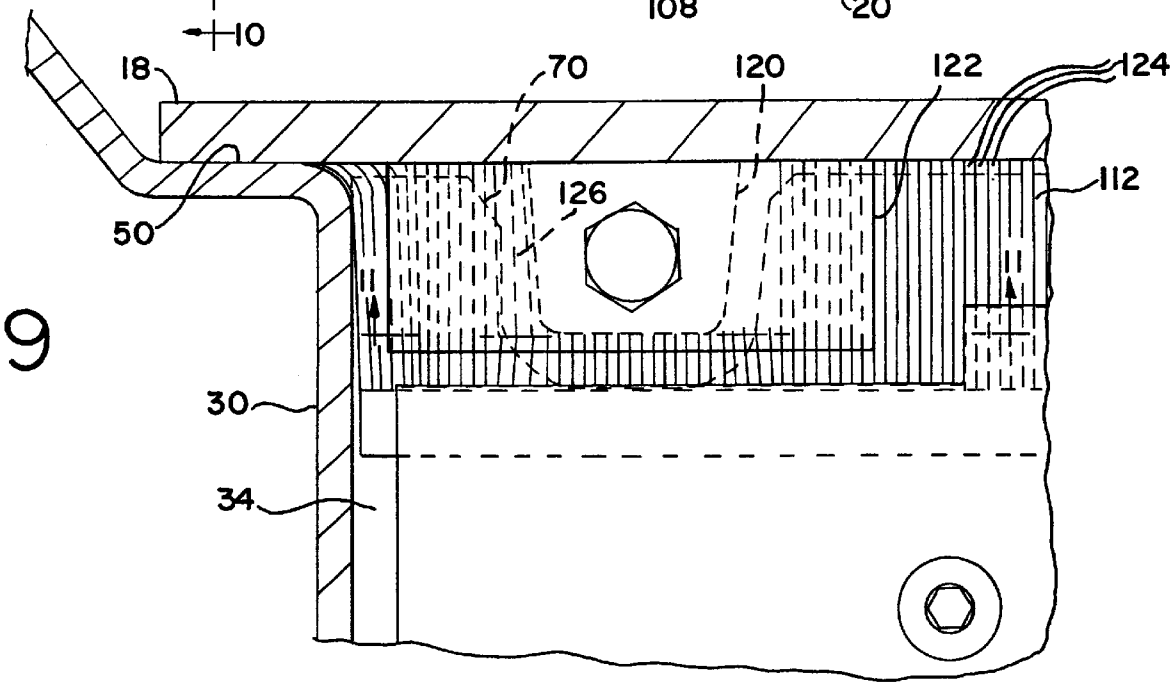
FIG. 9 is an enlarged view of a portion of FIG. 8 with the upper gate open.
Figure 11:
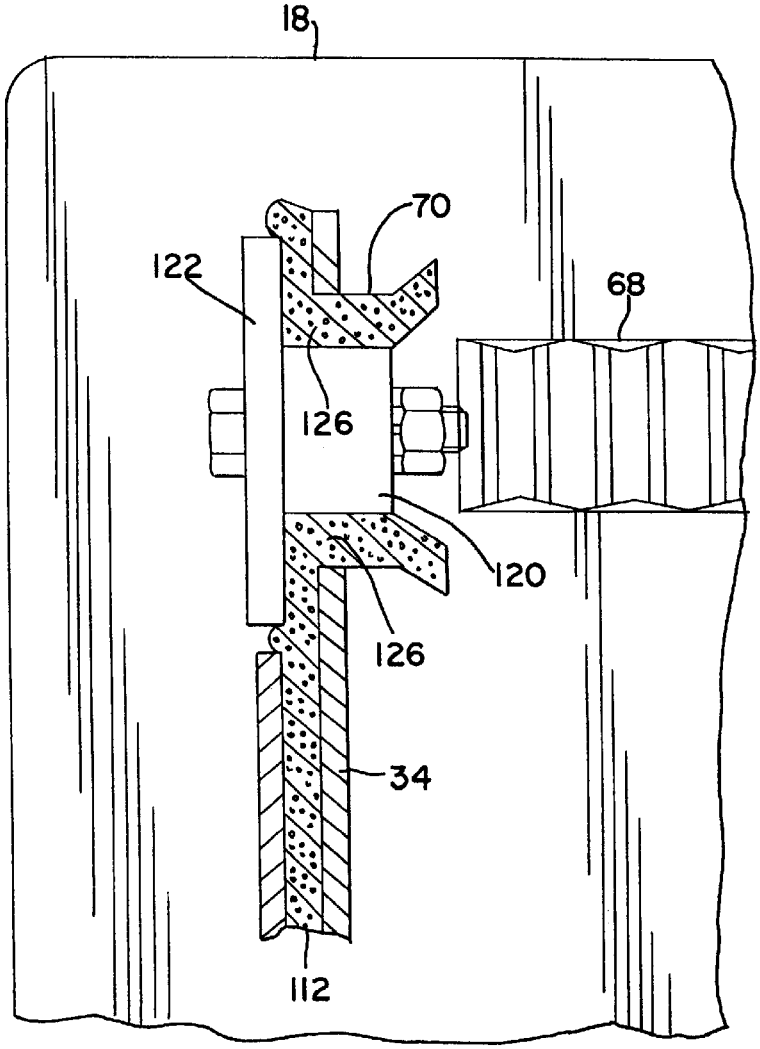
FIG. 11 is a sectional bottom view taken along line 11—11 of FIG. 9.
Figure 12:
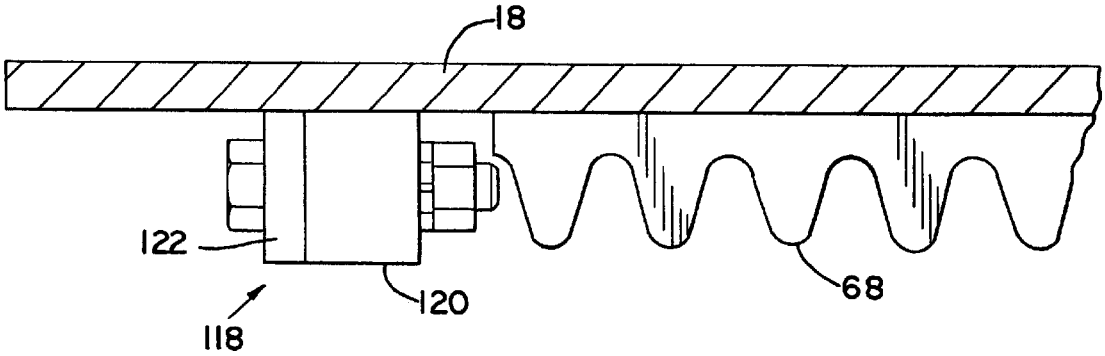
FIG. 12 is an enlarged view of a portion of FIG. 2 showing the rear end of the upper gate.

Racks 68 pass through the bristles of brush 112 as upper gate 18 is opened. Opening movement continues until the plug blocks 120 are moved into opening 70 and clamp plates 122 clamp the bristles 124 of brush 112 against front frame member 34 to prevent further opening of the gate by drive 22. The open position of the upper gate is illustrated in FIGS. 9, 10 and 11. The upper and lower gates are now in the fully opened position.

The seal units 118 tightly seal rack openings 70 when the upper gate 18 is fully opened. Plug blocks 120 are located in openings 70 and substantially close the openings. Each block 230 forces bristles 124 of brush 112 into the gap 126 between the block and the opening to tightly seal the gap. The clamp plates 122 extend beyond the full width of openings 70 and clamp bristles 124 to either side of the openings against the front frame member 34 to further seal the gap 126. Seal units 118 prevent contaminants from entering the interior of frame 12 through opening 70 when the upper gate is fully open. The units also prevent lading from leaking through openings 70.

With the upper and lower gates fully opened, lading enters the upper end of discharge chute 14 and is discharged through opening 38. Baffle plate 63 separates the flow of lading into two streams. The baffle plate can be removed if an unobstructed flow of lading is desired.

Bristles 124 of brush 112 engage the lower surface of upper gate 20 to prevent lading from entering between upper gate 18 and front frame member 34. The bristles of brush 108 prevent lading from discharging through lower slot 46 the bristles of brush 116 prevent lading from discharging through upper slot 44, and the bristles of brush 104 prevent lading from discharging through slot 48.

After gravity discharge of lading, the fully open outlet gate assembly 10 is moved to the fully closed and latched position by rotating either of the capstans 76 in a closing direction to move upper gate 18 inwardly. Lock plate 94 pushes plate 92 as upper gate 18 moves in the closing direction to move lower gate 20 closed with the upper gate 18. Upper and lower gates 18 and 20 continue closing movement until lower gate 20 engages door stop 100.

For vacuum discharge of lading, only upper gate 18 is opened. Lower gate 20 remains closed. Prior to opening, one or both nozzle covers 64 are removed from nozzles 62 and a vacuum hose is attached to one or both nozzles.

The upper and lower gates 18 and 20 must be unlocked from one another before opening the gate so that only upper gate 18 moves to the opened position. To unlock the gates, a worker rotates one of the lock handles 84 to the unlocked position. Opening rotation of a capstan 72 then moves upper gate 18 in the opening direction. Plates 94 on the lower surface of upper gate 18 move in the opening direction with upper gate 18, away from closed lower gate 20.

Upper gate 18 continues moving in the opening direction until clamp plates 132 press against front frame member 32 and prevent further opening movement by drive 22, as previously described. Upper gate 18 is fully opened and lower gate 20 remains closed. Clamp plates 122, plug blocks 120 and brush 112 tightly seal rack openings 70.

Lading enters the upper end of discharge chute 14 and is separated into two streams by baffle plate 63. Vacuum applied to the vacuum hoses reduces the air pressure within discharge chute 14 to below the outside air pressure. Outside air is drawn into discharge chute 14 through the brushes 104, 108, 112 and 116 and into the vacuum nozzles. The air is uniformly drawn into the front and rear of the discharge opening across the width of the opeing to aerate the lading and facilitate flow of lading under the baffle plate and into the vacuum nozzle or nozzles. Lading beneath baffle plate 63 is carried by the air flow through vacuum discharge openings 66, into vacuum nozzles 62 and through the vacuum hoses for discharge. Baffle plate 52 helps prevent clogging of fine grained materials flowing through the discharge chute and out of discharge openings 56. The brushes allow outside air to be drawn into discharge chute 14 but prevent outside contaminants from also being drawn into discharge chute 14 with the air. Air flows into the chute through small air flow passages extending past the bristles across the thickness of the brushes.

After vacuum discharge of lading, upper gate 18 is moved to the fully closed position as described by rotating either of the capstans 72 in a closing direction.

For pneumatic sled discharge of lading, both upper gate 18 and lower gate 22 are moved to the open position. Prior to opening, nozzle covers 64 are placed on nozzles 62 to prevent unwanted discharge of lading through discharge openings 66 and out of the open nozzles. Mud plate 40 is removed. Plate 40 keeps dirt off the lower surface of lower gate 20. The pneumatic sled (not shown) is aligned and sealed to flange 36.

The upper and lower gates 18 and 20 are opened as described. Once the gates are fully opened, lading falls through discharge chute 14 and into screw conveyors in the pneumatic sled. The pneumatic sled blows compressed air into discharge chute 14 and through the lading to separate the lading material. The separated material falls into the screw conveyors without clogging. The screw conveyors convey the lading away from the hopper car for discharge.

Brush 112 and seal units 118 seal rack openings 70 yet allow the racks 68 to move into and out of discharge chute 14 freely. Effective sealing permits use of a compact and less expensive opening and closing drive. Clamp plates 122 tightly clamp the bristles of brush 112 against the frame to allow the compact outlet gate assembly to be used for gravity discharge, vacuum discharge and pneumatic discharge of lading.

In the preferred embodiment, clamp members 136 also limit opening movement of upper gate 18. If desired, a separate stop member could be used to limit opening motion of upper gate 18.

If desired, the members of outlet gate assembly 10 that contact lading may be made from stainless steel for carrying food product lading or corrosive lading, such as potash.

While I have illustrated and described a preferred embodiment of the invention, it is understood that these embodiments are capable of modification, and we therefore do not wish to be limited to the precise details set forth, but desire to avail ourselves of such changes and alterations as fall within the purview of the following claims.

What I claim as my invention is:

1. An outlet gate assembly adapted to be mounted on a hopper container, said assembly comprising:

a frame defining a generally rectangular discharge opening, said frame having a frame side member with a first slot extending through the frame side member, and spaced first and second rack openings to one side of the slot, each said rack opening having a width;

a first gate mounted on the frame and extending through the first slot, the first gate having a width;

a drive for moving the first gate between open and closed positions, the drive including a first rack mounted on one side of the first gate, a second rack mounted on said one side of the first gate, a shaft rotatably mounted on the frame, and a pair of pinions on the shaft engaging the racks to move the first gate through the slot between opened and closed positions in response to rotation of the shaft, each of said racks including an end;

said first rack being aligned with the first rack opening and said second rack being aligned with the second rack opening;

a first clamp plate on said one side of the gate adjacent the end of the first rack, said first clamp plate having a width greater than the width of the first rack opening and less than the width of the gate;

a second clamp plate on one side of the gate adjacent the end of the second rack, said second clamp plate having a width greater than the width of the second rack opening and less than the width of the gate;

said first clamp plate being spaced from said second clamp plate;

each said clamp plate including a non-horizontal surface that is nearer to the pinion when the first gate is in the open position than when the first gate is in the closed position.

2. An outlet gate assembly adapted to be mounted on a hopper-type container, said assembly comprising:

a frame defining a generally rectangular discharge opening, said frame having a frame side member with a first slot extending through the frame side member, and a rack opening to one side of the slot, said rack opening having a width;

a first gate mounted on the frame and extending through the first slot;

a drive including a rack mounted on one side of the first gate and having an end, a shaft rotatably mounted on the frame, and a pinion on the shaft engaging the rack to move the first gate through the slot between opened and closed positions in response to rotation of the shaft, said rack including an end;

a clamp plate on the gate adjacent the end of the rack, said clamp plate having a width greater than the width of the rack opening; and a seal member mounted on the frame side member to one side of the first slot and extending across the discharge opening, said seal member overlying the rack opening and engaging said one side of the first gate, said rack extending through said seal member.

3. An outlet gate assembly as in claim 2 including air flow openings extending through the seal member.

4. An outlet gate assembly as in claim 3 wherein said seal member comprises a brush having a plurality of bristles and said air flow openings extend between adjacent bristles.

5. An outlet gate assembly as in claim 2 including a discharge outlet in the frame below the first gate; a second slot in the frame below the vacuum opening, a second gate on the frame extending through the second slot.

6. An outlet gate assembly as in claim 5 including and an engageable and disengageable gate lock mounted on the gates away from the discharge opening.

7. An outlet gate assembly as in claim 5 wherein said rack is on the bottom of the first gate, and said shaft is located on the outside of the discharge opening and between the first and second gates.

8. An outlet gate assembly as in claim 7 wherein said frame side member surrounds said shaft and pinion.

9. An outlet gate assembly comprising:

a frame having a side with a first slot extending through the frame side and a rack opening, said frame defining a generally rectangular discharge opening;

an upper gate mounted on said frame for opening and closing the upper end of the discharge opening, said upper gate extending through the first slot in said side of the frame and movable between open and closed positions, the upper gate having upper and lower sides;

a lower gate mounted on said frame for opening and closing the lower end of the discharge opening, said lower gate extending through a second slot in said side of the frame located below the first slot and movable between open and closed positions;

a discharge opening in the frame between the gates;

a gate drive including a rack on the upper gate, an operating shaft located outside of the discharge opening and a pinion on the operating shaft, the pinion engaging the rack; and a seal member mounted on said frame side and engaging the upper gate, said rack running through said seal.

10. An outlet gate assembly as in claim 9 wherein said seal member engages the lower side of said upper gate.

11. An outlet gate assembly as in claim 10 including air flow passages extending through the seal member.

12. An outlet gate assembly as in claim 11 wherein said seal member comprises a brush having a plurality of bristles, said air flow passages extending past said bristles.

13. An outlet gate assembly comprising:

a frame having a side, said frame defining a generally rectangular discharge opening, an upper gate mounted on said frame for opening and closing the upper end of the discharge opening, said upper gate extending through a first slot in said side of the frame and movable between open and closed positions;

a lower gate mounted on said frame for opening and closing the lower end of the discharge opening, said lower gate extending through a second slot in said side of the frame located below the first slot and movable between open and closed positions;

an engageable and disengageable gate lock on said gates to join said gates for movement together;

a discharge opening in the frame between the gates; and a gate drive including a rack on the upper gate, an operating shaft located outside of the discharge opening and a pinion on the operating shaft, the pinion engaging the rack;

a first seal member on said side of the frame, said seal member engaging one side of said upper gate;

wherein said first seal member engages the lower side of the upper gate, said rack is mounted on the lower surface of the upper gate, and said rack runs through the first seal member.

14. An outlet gate assembly as in claim 13 including a second seal member on said side of the frame, said second seal member engaging the upper side of said upper gate.

15. An outlet gate assembly as in claim 14 including a third seal member on said side of the frame, said third seal member engaging the upper surface at the lower gate; and a fourth seal member on another side of said frame across from said first side, said fourth seal member engaging the upper surface of said lower gate, all of said seal members comprising brushes.

16. An outlet gate assembly as in claim 9 wherein said rack is mounted on the lower side of the upper plate and said side of the frame surrounds the rack and the pinion gear.

17. An outlet gate assembly as in claim 9 wherein said upper and lower gates include end portions extending away from the discharge opening past said side of the frame, said lock gate mounted on said end portions of said upper and lower gates.

18. An outlet gage assembly as in claim 9 including an opening in said side of the frame adjacent the upper said rack running through said opening, and a clamp member located on the upper gate adjacent an end of the rack, said clamp member having a width greater than the width of said rack opening.

19. An outlet gate assembly as in claim 18 wherein said clamp member comprises a plate.

20. An outlet gate assembly comprising:

a frame having a side, said frame defining a generally rectangular discharge opening, an upper gate mounted on said frame for opening and closing the upper end of the discharge opening, said upper grate extending through a first slot in said side of the frame and movable between open and closed positions;

a lower gate mounted on said frame for opening and closing the lower end of the discharge opening, said lower gate extending through a second slot in said side of the frame located below the first slot and movable between open and closed positions;

an engageable and disengageable gate lock on said gates to join said gates for movement together;

a discharge opening in the frame between the gates; and a gate drive including a rack on the upper gate, an operating shaft located outside of the discharge opening and a pinion on the operating shaft, the pinion engaging the rack;

an opening in said side of the frame adjacent the upper gate, said rack running through said opening, and a clamp member located on the upper gate adjacent an end of the rack, said clamp member having a width greater than the width of said rack opening and comprising a plate; and a seal member on said side of the frame, said seal member extending across the width of the discharge opening and engaging the lower surface of the upper gate, said rack running through said seal member.

21. An outlet gate assembly as in claim 20 wherein said seal member comprises a brush, said clamp plate sandwiching said brush against said side of the frame when the upper gate is open.

22. An outlet gate assembly adapted to be mounted on a hopper container for holding a lading, said assembly comprising:

a frame defining a generally rectangular discharge opening, said frame having a frame side member with a first slot extending through the frame side member, and a rack opening to one side of the slot, said rack opening having a width;

a first gate mounted on the frame and extending through the first slot, the first gate having a width;

a drive including a rack mounted on one side of the first gate, a shaft rotatably mounted on the frame, and a pinion on the shaft engaging the rack to move the first gate through the slot between opened and closed positions in response to rotation of the shaft, said rack including an end; and a clamp plate on said one side of the gate adjacent the end of the rack, said clamp plate having a width greater than the width of the rack opening and less than one-half the width of the first gate, said rack opening being between said clamp plate and said pinion when said first gate is in the opened position.

23. An outlet gate assembly adapted to be mounted on a hopper container containing a lading, said outlet gate assembly comprising:

a frame having a side, said frame defining a generally rectangular discharge opening, an upper gate mounted on said frame for opening and closing the upper end of the discharge opening, said upper gate extending through a first slot in said side of the frame and movable between open and closed positions, the upper gate having a lower surface;

a lower gate mounted on said frame for opening and closing the lower end of the discharge opening, said lower gate extending through a second slot in said side of the frame located below the first slot and movable between open and closed positions, the lower gate having an upper surface;

a discharge opening in the frame between the gates;

a non-metallic seal attached to the frame and in contact with the lower surface of the upper gate;

a non-metallic seal attached to the frame and in contact with the upper surface of the lower gate; and a gate drive including a rack fixed to the lower surface of the upper gate, an operating shaft located outside of the discharge opening and a pinion on the operating shaft, the pinion engaging the rack, the rack moving with the upper gate when the upper gate is moved between the open and closed position; and at least one vacuum inlet opening extending through the frame between the upper gate and lower gate for vacuum discharge of the lading.

24. An outlet gate assembly adapted to be mounted on a hopper container containing a lading, said outlet gate assembly comprising:

a frame having a side, said frame defining a generally rectangular discharge opening, an upper gate mounted on said frame for opening and closing the upper end of the discharge opening, said upper gate extending through a first slot in said side of the frame and movable between open and closed positions, the upper gate having a lower surface;

a lower gate mounted on said frame for opening and closing the lower end of the discharge opening, said lower gate extending through a second slot in said side of the frame located below the first slot and movable between open and closed positions, the lower gate having an upper surface;

an engageable and disengageable gate lock on said gates to join said gates for movement together;

a discharge opening in the frame between the gates;

a gate drive including a rack fixed to the lower surface of the upper gate, an operating shaft located outside of the discharge opening and a pinion on the operating shaft, the pinion engaging the rack, the rack moving with the upper gate when the upper gate is moved between the open and closed positions; and a seal positioned between the level of the upper gate and the level of the lower gate and contacting the upper side of the lower gate when the lower gate is in the open and closed positions.

* * * * *